United States Patent [19]

Satake et al.

[11] Patent Number: 4,463,665

[45] Date of Patent: Aug. 7, 1984

[54] PRESSURE PLATE ADJUSTING DEVICE FOR GRAIN WHITENING APPARATUS

[75] Inventors: Toshihiko Satake; Kiyoto Kagawa; Shigeru Ariji, all of Higashihiroshima, Japan

[73] Assignee: Satake Engineering Co., Ltd., Tokyo, Japan

[21] Appl. No.: 517,762

[22] Filed: Jul. 27, 1983

[30] Foreign Application Priority Data

Dec. 10, 1982 [JP] Japan ..... 57-217332

[51] Int. Cl.[3] ..... B02B 3/00; B02B 7/02

[52] U.S. Cl. ..... 99/488; 49/387; 99/519; 99/606; 99/611; 220/211

[58] Field of Search ..... 99/516, 486, 518, 488, 99/520–522, 525, 526, 528, 568, 602–606, 612–614, 617, 519, 609–611; 366/189, 192, 194, 196; 220/211; 49/386, 387; 241/6, 7, 33, 36, 37

[56] References Cited

U.S. PATENT DOCUMENTS 4,148,251 4/1979 Satake ..... 99/519

4,323,006 4/1982 Satake ..... 99/519

*Primary Examiner*—Timothy F. Simone

*Attorney, Agent, or Firm*—Wegner & Bretschneider

[57] ABSTRACT

Disclosed is an improvement in a pressure plate adjusting device for grain whitening apparatus which is capable of automatically and precisely adjusting the pressure of a pressure plate disposed at a rice outlet of a whitening chamber. The automatic adjustment has been made possible by the provision of reversible electric motor mounted on one end wall of a casing enclosing a pressure control screw shaft, a weight mounted on said screw shaft and a guide rod for guiding the movement of said weight, and a control unit producing a control signal having relation to the conditions of whitening action of grains within the whitening chamber and controlling the direction and the amount of rotation of said motor.

4 Claims, 2 Drawing Figures

PRESSURE PLATE ADJUSTING DEVICE FOR GRAIN WHITENING APPARATUS

BACKGROUND OF THE INVENTION

The present invention relates to an improvement in a pressure plate adjusting device for grain whitening apparatus.

Generally, in whitening apparatus, the reduction in the number of revolutions of the whitening roller within the apparatus takes place with the progress of whitening action. In order to keep constant or stable the load of grains in the whitening chamber, it is necessary to complement the increase and decrease of the load in proportion to the reduction in the number of revolutions of the whitening roller, and also to complement the increase and decrease of the load caused by such factors as the variation in the grain flow. To achieve this, the most convenient way is to increase or decrease the pressure of the pressure plate against the rice outlet of the whitening chamber.

In the conventional whitening apparatus, the above adjustment of the pressure plate has been performed by manual methods, i.e. by adjusting the adjustor of an elastic spring connected to the pressure plate or moving the weight mounted on the pressure adjusting rod carrying the pressure plate at its one end. Such conventional whitening apparatus has a drawback since it is difficult to effect adjustment and it necessitates fine manual adjustment requiring an experienced person in order to obtain the desired degree of whitening of grains.

SUMMARY OF THE INVENTION

It is, therefore, a primary object of the present invention to provide a pressure plate adjusting device for grain whitening apparatus which is capable of automatically adjusting the pressure of the pressure plate, thereby achieving an accurate adjustment while saving labor.

Another object of the present invention is to provide a pressure plate adjusting device having a simple construction and a high performance which enables automatic and precise adjustment.

In accordance with the present invention, there is provided a pressure plate adjusting device for grain whitening apparatus, capable of adjusting the pressure of a pressure plate in said apparatus against grain being forced out of a whitening chamber in said apparatus. The device comprises: a pressure control casing; a rod horizontally extending from said pressure control casing and carrying said pressure plate, said pressure plate being swingable with said rod acting as axis of rotation; a reversible electric motor mounted on said casing; a pressure control screw shaft disposed within said casing and carried by the shaft of said motor; a weight mounted on said screw shaft and movable forwardly or backwardly in accordance with the rotation of said motor; a guide rod disposed within said casing for guiding the movement of said weight; and a control unit producing a control signal having relation to the conditions of whitening action of grains within said whitening chamber and controlling the direction and the amount of rotation of said motor.

BRIEF DESCRIPTION OF THE DRAWINGS

This invention will now be further described, by way of example, with reference to the accompanying drawings, in which.

DESCRIPTION OF THE PREFERRED EMBODIMENT

Figure 1:
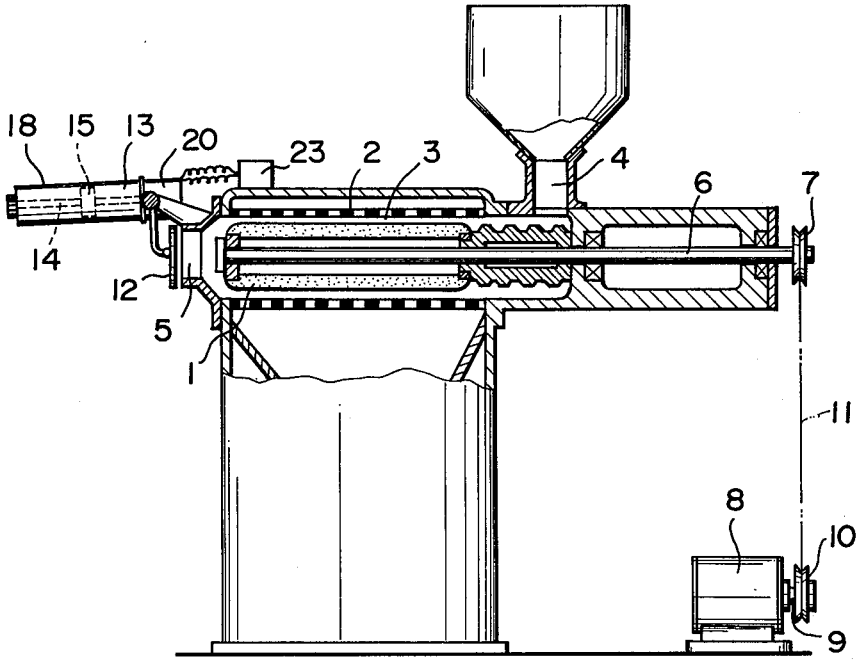
FIG. 1 is a side elevational view, partly in section, of the essential part of grain whitening apparatus.

An example of the pressure plate adjusting device for grain whitening apparatus embodying the present invention is shown diagrammatically in partial section view in FIG. 1.

A whitening chamber 3 comprising a whitening roller 1 rotatably mounted within a perforated screen cylinder 2 has a rice inlet 4 at its one end and a rice outlet 5 at its another end. A driven pulley 7 secured to a main shaft 6 of the whitening roller 1 is connected by a belt 11 to a drive pulley 10 secured to a shaft 9 of an electric motor 8 disposed underneath the whitening apparatus. A pressure plate 12 is disposed at the rice outlet 5 of the whitening chamber 3 and is connected to the pressure adjusting device 13 of the present invention wherein a weight 15 engaging a pressure control screw shaft 14 moves in a forward or backward direction, thereby enabling an adjustment of the degree of whitening.

Figure 2:
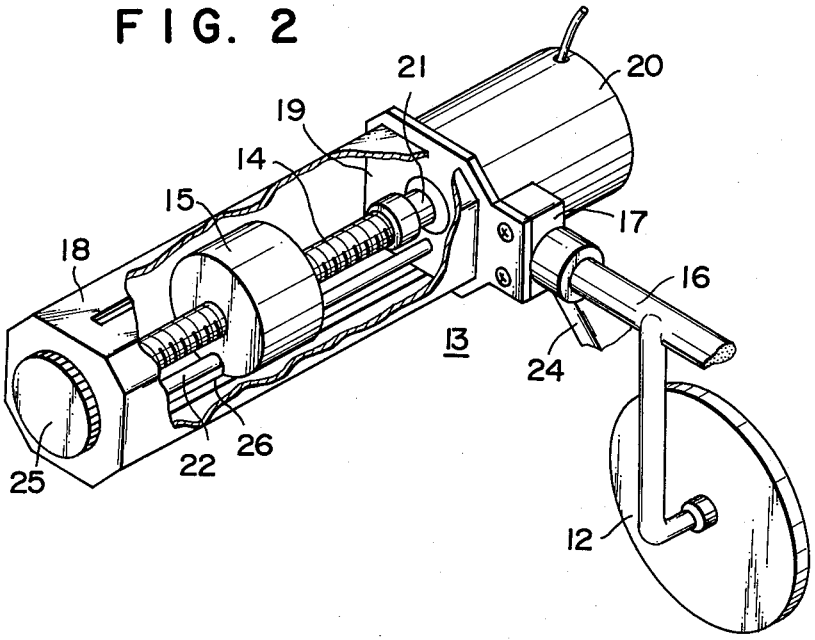
FIG. 2 is a perspective view, again partly in section, of one embodiment of the pressure plate adjusting device according to the present invention.

Referring next to FIG. 2, a detail structure of the pressure adjusting device 13 for the pressure plate 12 will hereunder be explained. A pressure plate 12 is carried by a horizontally extending rod 16 so as to be swingable with the rod 16 acting as an axis of rotation. A side portion of a pressure control casing 18 is fixed to a holding member 17 in such manner that the casing 18 and the rod 16 make a right angle. On one outer end wall 19 of the casing 18 there is mounted a reversible electric motor 20, and a pressure control screw shaft 14 disposed within the casing 18 is fixedly connected to the shaft 21 of this motor. A weight 15 engages the screw shaft 14 and the movement thereof is guided by a guide rod 22 disposed within the casing 18. The electric motor 20 is electrically coupled or connected to a control unit 23 which produces a control signal based upon changes in the conditions or changes of the load of the rice grains undergoing whitening action within the whitening chamber 3. The reference numeral 24 indicates a supporting member for the horizontally extended rod 16.

When the brown rice grains are supplied to the whitening apparatus and it starts operating, the whitening roller 1 in the whitening chamber 3 rotates and performs the whitening of the rice grains fed into the whitening chamber 3. With the progress of whitening action, the load of grains within the whitening chamber 3 changes thereby reducing the number of revolutions of the whitening roller 1 and also the variation of the coefficient of the friction caused by, for example, the quantity of generated powdered bran or moisture content of the brown rice to be whitened, causes the changes in such load of grains. Thus, by way of detecting the changes of the load of grains through, for example, the changes in power supply current to the motor 8 arranged for the whitening apparatus and feeding the control signal corresponding to the above changes of the load to a drive circuit (not shown) arranged at the motor 20 through a control unit 23, the electric motor 20 responds to rotate the pressure adjusting screw shaft 14 in a forward or reverse direction at a required rotation value thereby moving the weight 15 mounted on the screw shaft 14 at a required length and stopping it at an appropriate and desired position. The load of grains within the whitening chamber 3 is thus compensated and stabilized in a timely manner, thereby ensuring the highest efficiency and the highest whitening yield rate.

The pressure plate adjusting device of the present invention further comprises a handle 25 adapted to allow manual rotation of the screw shaft 14, this handle 25 being arranged at the end wall of the casing 18 opposite to the wall where the motor 20 is mounted. Therefore, when there occurs any trouble in, for example, the motor 20 of the device, it is still possible to safely continue the whitening operation without interruption by manually rotating the above handle 25, that is, the screw shaft 14 so as to cause the movement of the weight 15 on the screw shaft 14, thereby achieving the emergency adjustment of the pressure of the pressure plate 12.

In the device of the present invention, adjacent the wall of the casing 18 there is provided a potentiometer 26 for the weight 15. This potentiometer 26 detects the position of the movement of the weight 15 and sends its detected signal to the control unit 23 to be compared with the value of the supply current to the motor 8 of the whitening apparatus. The control unit 23 then operates to control the movement of the weight 15 based upon the above comparison. According to this embodiment, it is possible to prevent an error of movement and a hunting phenomenon caused from the time lag which arises in the case where the movement of the weight 15 is controlled based upon only the load current of the motor 8, thereby enabling to control the pressure of the pressure plate timely and precisely without errors so as to ensure continuous whitening operation with high performance.

Further, it should be noted that automatic adjustment of the pressure of the pressure plate can also be achieved by use of the signal associated with the degree of milling or whitening, which is measured on the reflected and/or transmitted light from the grains, as the control signal for the aforesaid reversible motor 20. Apparatus for measuring the degree of milling or whitening based upon the reflected and transmitted light from the grains has been described in the U.S. patent application Ser. No. 486,808, filed on Apr. 19, 1983 (in which application one of the co-inventors is a co-inventor of the invention of the present application) and thus the relevant disclosure therein is incorporated herein by reference.

As has been described above, according to the present invention, due to its automatic adjustment of the pressure of the pressure plate and its simple construction, a high performance whitening action and a saving of labor can be achieved and also high quality white rice can be mass-processed smoothly and quickly.

While one specific embodiment of the invention has been described and illustrated, various modifications in the construction and arrangement of the components may be adopted without, however, departing from the spirit and scope of the invention as defined in the following claims.

What is claimed is:

1. A pressure plate adjusting device for a grain whitening apparatus, capable of adjusting the pressure of a pressure plate in said apparatus against grain being forced out of a whitening chamber in said apparatus, said device comprising:

a pressure control casing;

a rod horizontally extending from said pressure control casing and carrying said pressure plate, said pressure plate being swingable with said rod acting as axis of rotation;

a reversible electric motor mounted on said casing;

a pressure control screw shaft disposed within said casing and carried by the shaft of said motor;

a weight mounted on said screw shaft and movable forwardly or backwardly in accordance with the rotation of said motor;

a guide rod disposed within said casing for guiding the movement of said weight; and a control unit producing a control signal having relation to the conditions of whitening action of grains within said whitening chamber and controlling the direction and the amount of rotation of said motor.

2. A pressure plate adjusting device for grain whitening apparatus according to claim 1 in which said control signal produced by said control unit corresponds to the increase and decrease of the load within said whitening chamber of the apparatus.

3. A pressure plate adjusting device for grain whitening apparatus according to claim 1 comprising a handle arranged at the end wall of said casing opposite to the wall where said motor is mounted, said handle enabling to allow manual rotation of said screw shaft.

4. A pressure plate adjusting device for grain whitening apparatus according to claim 1 further comprising a potentiometer arranged adjacent the wall of said casing for detecting the position of said weight and sending its detected signal to said control unit.

* * * * *